US008556732B2

(12) United States Patent
Raichman et al.

(10) Patent No.: US 8,556,732 B2
(45) Date of Patent: Oct. 15, 2013

(54) METHOD AND AN APPARATUS FOR MANAGING GAMES AND A LEARNING PLAYTHING

(75) Inventors: Yossef Raichman, Herzlia (IL); Moshe Cohen, Tel-Aviv (IL); Bahram Nour-Omid, Los Angeles, CA (US)

(73) Assignee: In-Dot Ltd., Tel-Aviv (IL)

( * ) Notice: Subject to any disclaimer, the term of this patent is extended or adjusted under 35 U.S.C. 154(b) by 132 days.

(21) Appl. No.: 12/867,259

(22) PCT Filed: Jan. 8, 2009

(86) PCT No.: PCT/IL2009/000030

§ 371 (c)(1), (2), (4) Date: Aug. 12, 2010

(87) PCT Pub. No.: WO2009/101610

PCT Pub. Date: Aug. 20, 2009

(65) Prior Publication Data

US 2010/0311507 A1 Dec. 9, 2010

Related U.S. Application Data

(60) Provisional application No. 61/064,053, filed on Feb. 13, 2008.

(51) Int. Cl.
*A63F 9/24* (2006.01)

(52) U.S. Cl.
USPC ..... 463/46; 463/9; 463/43

(58) Field of Classification Search
USPC ..... 463/9, 30–33, 43, 46
See application file for complete search history.

(56) References Cited

U.S. PATENT DOCUMENTS

| | | | | |
|---|---|---|---|---|
| 3,910,701 | A | | 10/1975 | Henderson et al. |
| 4,540,176 | A | | 9/1985 | Baer |
| 4,604,065 | A | | 8/1986 | Frazer et al. |
| 4,608,601 | A | | 8/1986 | Shreck et al. |
| 4,729,564 | A | | 3/1988 | Kuna et al. |
| 4,917,500 | A | | 4/1990 | Lugos |
| 5,059,126 | A | | 10/1991 | Kimball |
| 5,190,285 | A | * | 3/1993 | Levy et al. ..... 463/36 |
| 5,196,683 | A | | 3/1993 | Marom et al. |

(Continued)

FOREIGN PATENT DOCUMENTS

| | | |
|---|---|---|
| EP | 0094502 | 11/1983 |
| FR | 2885251 | 11/2006 |

(Continued)

OTHER PUBLICATIONS

PlayStation® Portable Instruction Manual, © 2005 Sony, pp. 1-49 and appendices i-iv.*

(Continued)

*Primary Examiner* — Arthur O. Hall
*Assistant Examiner* — Steve Rowland

(57) ABSTRACT

A plaything having adjustable game attributes. The plaything comprises a reading unit for reading a unique machine-readable representation of game related information from a labeled game element and a memory for hosting an attribute record characterizing at least one game attribute of a game. The plaything further comprises a learning module for updating the attribute record according to the game related information and a presentation unit for expressing the game attribute according to the updated attribute record.

22 Claims, 10 Drawing Sheets

(56) References Cited

U.S. PATENT DOCUMENTS

| | | | | |
|---|---|---|---|---|
| 5,260,553 | A | 11/1993 | Rockstein et al. | |
| 5,303,037 | A | 4/1994 | Taranowski | |
| 5,314,336 | A | 5/1994 | Diamond et al. | |
| 5,569,902 | A | 10/1996 | Wood et al. | |
| 5,574,804 | A | 11/1996 | Olschafskie et al. | |
| 5,736,410 | A | 4/1998 | Zarling et al. | |
| 5,795,213 | A | 8/1998 | Goodwin | |
| 5,853,327 | A * | 12/1998 | Gilboa | 463/39 |
| 5,912,454 | A | 6/1999 | Castillo et al. | |
| 5,945,656 | A | 8/1999 | Lemelson et al. | |
| 6,048,209 | A | 4/2000 | Bailey | |
| 6,064,421 | A | 5/2000 | Pohl | |
| 6,089,943 | A | 7/2000 | Lo | |
| 6,091,513 | A | 7/2000 | Ishihara et al. | |
| 6,249,348 | B1 | 6/2001 | Jung et al. | |
| 6,290,565 | B1 | 9/2001 | Galyean, III et al. | |
| 6,319,010 | B1 | 11/2001 | Kikinis | |
| 6,330,427 | B1 | 12/2001 | Tabachnik | |
| 6,354,502 | B1 | 3/2002 | Hagstrom et al. | |
| 6,377,249 | B1 | 4/2002 | Mumford | |
| 6,392,214 | B1 | 5/2002 | Okamoto | |
| 6,551,165 | B2 | 4/2003 | Smirnov | |
| 6,574,425 | B1 | 6/2003 | Weiss et al. | |
| 6,773,344 | B1 | 8/2004 | Gabai et al. | |
| 6,835,131 | B1 * | 12/2004 | White et al. | 463/1 |
| 6,905,391 | B2 | 6/2005 | Soto et al. | |
| 7,044,429 | B1 | 5/2006 | Foreman et al. | |
| 7,062,073 | B1 | 6/2006 | Tumey et al. | |
| 7,261,612 | B1 | 8/2007 | Hannigan et al. | |
| 7,338,377 | B2 * | 3/2008 | Shinoda | 463/47 |
| 7,369,261 | B2 | 5/2008 | Silverbrook et al. | |
| 7,397,464 | B1 * | 7/2008 | Robbins et al. | 345/173 |
| 7,645,178 | B1 | 1/2010 | Trotto et al. | |
| 7,883,420 | B2 | 2/2011 | Bradbury et al. | |
| 8,055,899 | B2 | 11/2011 | Levy et al. | |
| 2001/0030748 | A1 | 10/2001 | Jung et al. | |
| 2002/0008145 | A1 | 1/2002 | Walsh et al. | |
| 2002/0022523 | A1 | 2/2002 | Dan et al. | |
| 2002/0049833 | A1 | 4/2002 | Kikinis | |
| 2002/0097400 | A1 | 7/2002 | Jung et al. | |
| 2003/0003839 | A1 | 1/2003 | Lin | |
| 2003/0056869 | A1 | 3/2003 | Tate et al. | |
| 2003/0227628 | A1 | 12/2003 | Kreimer et al. | |
| 2004/0214642 | A1 | 10/2004 | Beck | |
| 2005/0073722 | A1 | 4/2005 | Silverbrook et al. | |
| 2005/0082369 | A1 | 4/2005 | Benedetti | |
| 2005/0106547 | A1 | 5/2005 | Chiu | |
| 2005/0121524 | A1 | 6/2005 | Silverbrook et al. | |
| 2005/0125228 | A1 | 6/2005 | Samuels | |
| 2005/0146615 | A1 | 7/2005 | Silverbrook et al. | |
| 2005/0151966 | A1 | 7/2005 | Packirisamy et al. | |
| 2006/0223637 | A1 | 10/2006 | Rosenberg | |
| 2007/0108287 | A1 | 5/2007 | Davis et al. | |
| 2007/0229859 | A1 | 10/2007 | Lapstun et al. | |
| 2007/0296552 | A1 | 12/2007 | Huang et al. | |
| 2008/0003043 | A1 | 1/2008 | Fukui et al. | |
| 2008/0048396 | A1 | 2/2008 | Andersen | |
| 2009/0005167 | A1 | 1/2009 | Arrasvuori et al. | |
| 2009/0197658 | A1 * | 8/2009 | Polchin | 463/9 |
| 2010/0044441 | A1 | 2/2010 | Cohen et al. | |
| 2010/0157396 | A1 | 6/2010 | Kim et al. | |
| 2010/0219251 | A1 | 9/2010 | Decoux et al. | |
| 2011/0027770 | A1 | 2/2011 | Cohen et al. | |
| 2011/0310617 | A1 | 12/2011 | Cornelissen et al. | |

FOREIGN PATENT DOCUMENTS

| | | |
|---|---|---|
| GB | 2133951 | 8/1984 |
| GB | 2186415 | 8/1987 |
| JP | 2005-034442 | 2/2005 |
| KR | 2001-0093468 | 10/2001 |
| WO | WO 99/46581 | 9/1999 |
| WO | WO 00/15316 | 3/2000 |
| WO | WO 00/79504 | 12/2000 |
| WO | WO 02/07841 | 1/2002 |
| WO | WO 2005/029697 | 3/2005 |
| WO | WO 2006/058204 | 6/2006 |
| WO | WO 2007/124469 | 11/2007 |
| WO | WO 2008/011054 | 1/2008 |
| WO | WO 2008/111054 | 9/2008 |
| WO | WO 2008/111055 | 9/2008 |
| WO | WO 2009/101610 | 8/2009 |
| WO | WO 2009/113067 | 9/2009 |
| WO | WO 2009/125393 | 10/2009 |

OTHER PUBLICATIONS

Official Action Dated Mar. 21, 2012 From the US Patent and Trademark Office Re. U.S. Appl. No. 12/530,482.

Communication Relating to the Results of the Partial International Search Dated Apr. 12, 2010 From the Interantional Searching Authority Re.: Application No. PCT/IL2009/000275.

International Preliminary Report on Patentability Dated Jun. 5, 2009 From the International Preliminary Examining Authority Re.: Application No. PCT/IL2008/000325.

International Preliminary Report on Patentability Dated Sep. 24, 2009 From the International Bureau of WIPO Re.: Application No. PCT/IL2008/000324.

International Search Report and the Written Opinion Dated Jul. 12, 2010 From the Interantional Searching Authority Re.: Application No. PCT/IL2009/000275.

International Search Report Dated Jul. 2, 2008 From the International Searching Authority Re.: Application No. PCT/2008/000325.

International Search Report Dated Sep. 2, 2009 From the International Searching Authority Re.: Application No. PCT/IL2009/000030.

International Search Report Dated Jul. 13, 2009 From the International Searching Authority Re.: Application No. PCT/IL2009/000378.

International Search Report Dated Dec. 17, 2008 From the International Searching Authority Re.: Application No. PCT/IL2008/000324.

Written Opinion Dated Jul. 2, 2008 From the International Searching Authority Re.: Application No. PCT/II2008/000325.

Written Opinion Dated Sep. 2, 2009 From the International Searching Authority Re.: Application No. PCT/IL2009/000030.

Written Opinion Dated Jul. 13, 2009 From the International Searching Authority Re.: Application No. PCT/IL2009/000378.

Written Opinion Dated Dec. 17, 2008 From the International Searching Authority Re.: Application No. PCT/IL2008/000324.

International Preliminary Report on Patentability Dated Sep. 23, 2010 From the International Bureau of WIPO Re. Application No. PCT/IL2009/000275.

International Preliminary Report on Patentability Dated Oct. 21, 2010 From the International Bureau of WIPO Re. Application No. PCT/IL2009/000378.

Communication Relating to the Results of the Partial International Search Dated Apr. 12, 2010 From the International Searching Authority Re.: Application No. PCT/IL2009/000275.

International Search Report and the Written Opinion Dated Jul. 12, 2010 From the International Searching Authority Re.: Application No. PCT/IL2009/000275.

Official Action Dated Oct. 24, 2011 From the US Patent and Trademark Office Re. U.S. Appl. No. 12/530,482.

International Preliminary Report on Patentability Dated Aug. 26, 2010 From the International Bureau of WIPO Re. Application No. PCT/IL2009/000030.

Official Action Dated Oct. 19, 2012 From the US Patent and Trademark Office Re. U.S. Appl. No. 12/920,465.

Official Action Dated Dec. 28, 2012 From the US Patent and Trademark Office Re. U.S. Appl. No. 12/936,217.

(56) References Cited

OTHER PUBLICATIONS

Restriction Official Action Dated Jul. 24, 2012 From the US Patent and Trademark Office Re. U.S. Appl. No. 12/920,465.
Official Action Dated Mar. 14, 2013 From the US Patent and Trademark Office Re. U.S. Appl. No. 12/530,480.
Applicant-Initiated Interview Summary Dated Jun. 13, 2013 From the US Patent and Trademark Office Re. U.S. Appl. No. 12/920,465.
Official Action Dated Jun. 11, 2013 From the US Patent and Trademark Office Re. U.S. Appl. No. 12/936,217.
Official Action Dated Apr. 16, 2013 From the US Patent and Trademark Office Re. U.S. Appl. No. 12/920,465.

* cited by examiner

METHOD AND AN APPARATUS FOR MANAGING GAMES AND A LEARNING PLAYTHING

FIELD AND BACKGROUND OF THE INVENTION

The present invention, in some embodiments thereof, relates to a plaything and a method for using labeled game elements and, more particularly, but not exclusively, to a plaything and a method for using labeled game elements in interactive game.

Games, play structures and other similar entertainment systems are well known for providing play and interaction among children and adults. A wide variety of commercially available play toys and games are also known for providing valuable learning and entertainment opportunities for children, such as role playing, reading, memory stimulation, tactile coordination and the like.

During the last years, interactive games, which provide rewards for making correct cognitive selections and feedback for incorrect selections have been developed. For example, U.S. Patent Application No. 2005/0137004, published on Jan. 23, 2005 describes an interactive game that includes a game board, a plurality of objects, and an electronic apparatus. The electronic apparatus includes an object reader, a processor unit coupled to the card reader, a memory unit coupled to the processor unit, and a speaker coupled to the processor unit. The memory unit comprises code for prompting a player to select an object, and providing an instruction to the player.

Another example, which is described in U.S. Patent Application No. 2003/0094759, published on May 22, 2003 disclosed a method of game play and constituent game components. The game is a role-playing game (RPG) with physical game pieces and rules for their use, where gamers assume the roles of imaginary characters in a fictitious storyline. The game places specific emphasis on flexible character composition, physical conflict resolution, magical powers, and the performance of weapons, tools, and technology. One objective of the game is to provide role-playing organization that is simple and physical game pieces that incorporate strategy, chance, and imagery. The game is designed in a modular way, and any module could be deployed independently to support the role-playing objectives of gamers. Characters are described by demographic information as well as numerical representations of attributes, skills, and abilities. Players' characters interact in open-ended and imaginative ways under the direction of a referee, or under an agreed-upon system for negotiating ambiguous situations. the game is distinguished from other RPGs by rule content, as well as a diversity of physical gaming components that interface with the rules. Some gaming components are represented in a static card format, containing information on their uses and effects. These cards may become interactive game pieces when they act together physically or systematically with other cards and components in the game. Sophisticated, interactive gaming devices called Artifacts—with counters that can be adjusted to represent various gaming variables-act as input/output calculators or data-restriction filters. These Artifacts typically function as a multitasking linear slide rule and/or rotary disk counter, where a gamer inputs values representing ability, chance, or circumstance on the counters, and the Artifact reveals the final effects or potential effects. Furthermore, the characters themselves are described with cards and counters. These are directed at making game-play free from manual record keeping. Gaming components may be obtained from retail outlets, Internet download sites, trading with other enthusiasts, and winning components at games and tournaments.

SUMMARY OF THE INVENTION

According to an aspect of some embodiments of the present invention there is provided plaything having adjustable game attributes. The plaything comprises a reading unit for reading a unique machine-readable representation of game related information from a labeled game element and a memory for hosting an attribute record characterizing at least one game attribute of a game. The plaything further comprises a learning module for updating the attribute record according to the game related information and a presentation unit for expressing the game attribute according to the updated attribute record.

Optionally, the game attribute is selected from a group consisting of: an action of the plaything, a reaction of the plaything to an action of a player, a reaction of the plaything to the reading, a progress in the game, and a status of a player in the game.

Optionally, the at least one attribute record is associated with a plurality of media records, the game related information being indicative of at least one of the plurality of media records, the presentation unit being performing the expressing by playing the at least one media record.

Optionally, the plaything is a pawn indicating a progress of a player in a multi-stage game, the game related information being associated with an indication to a stage in the multi-stage game, the at least one game attribute define the progress.

More optionally, the multi-stage game is selected from a group comprising: a board game, a card ordering game, and an elements ordering game.

Optionally, the labeled game element is selected from a group consisting of: a card, a plastic game element, a fastened plastic block, and a pawn.

Optionally, the presentation unit comprises a member selected from a group consisting of: a screen, a speaker, a light emitting diode (LED), a vibrating unit, a unit for setting the plaything in motion, and a unit for setting a part of the plaything in motion.

Optionally, the plaything further comprises a communication interface for communicating with an additional plaything, the presentation unit being configured for performing the expressing in response the communication.

Optionally, the plaything further comprises a communication interface for communicating with a computing unit, the presentation unit being configured for performing the expressing in response the communication.

Optionally, the plaything further comprises a communication interface for communicating with a player, the presentation unit being configured for performing the expressing in response the communication.

Optionally, the reading unit performs the reading using a member of a group consisting of: a photoelectric sensor, an image sensor, a color sensor, and Infrared (IR) sensor.

Optionally, the plaything is a pawn indicating a character having at least one property in a multiplayer game, the game related information being associated with an indication to a change in the property, the at least one game attribute define a current level of the property.

Optionally, the at least one attribute record records a development of a game played by a plurality of players, the game related information define an action taken by one of the plurality of players.

Optionally, the learning module comprises a game management module configured for identifying a progress in the game according to the at least one updated attribute record, the presentation unit configured for expressing the progress.

Optionally, the reading unit is configured for reading a plurality of unique machine-readable representations of game related information from at least one labeled game element.

More optionally, a first of the plurality of unique machine-readable representations is indicative as a question and a second of the plurality of unique machine-readable representations being indicative as an answer, the learning module configured for updating the at least one attribute record with the question and verifying the answer according to the updated attribute record.

Optionally, the reading unit is configured for reading a plurality of unique machine-readable representations in an order, the order being indicative as the game related information.

Optionally, the plaything further comprises a timing module for measuring time between the readings of at least two of the plurality of unique machine-readable representations.

Optionally, the reading unit is configured for reading the unique machine-readable representation from a combination of a plurality of labeled game elements.

According to an aspect of some embodiments of the present invention there is provided a game card that indicates game related information to a sensor based plaything storing a game status. The game card comprises a card body, a game indication indicating game related information, the indication being identifiable by a player, and a unique machine-readable representation of the game related information. The unique machine-readable representation is configured to be read by the sensor based plaything. The game indication and the unique machine-readable are attached to the card body, the unique machine-readable representation being configured for updating the sensor based plaything with the game related information.

Optionally, the game indication and the unique machine-readable are attached to the card body by a member selected from a group consisting of printing and adhering According to an aspect of some embodiments of the present invention there is provided a method for managing a game. The method comprises: a) allowing a player to use a sensor based plaything for reading a unique machine-readable representation of game related information from at least one labeled game element, b) updating at least one game attribute being related to the player according to the game related information, and c) expressing the updated game attribute according to the update.

Optionally, the method further comprises using the sensor for reading at least one additional unique machine-readable representation of additional game related information and updating the at least one game attribute according to the additional game related information before c).

More optionally, the additional game related information is printed on an additional labeled game element.

Optionally, the at least one labeled game element comprises a plurality of labeled game elements.

Optionally, the method further comprises providing the plurality of labeled game elements before the a), wherein each the labeled game element comprises a portion of the unique machine-readable representation.

According to an aspect of some embodiments of the present invention there is provided a pawn having a plurality of adjustable properties. The pawn comprises a memory for hosting a plurality of game instructions identifiers, each the game instructions identifier being associated with at least one of the plurality of adjustable properties, a reading unit configured for detecting at least one of the plurality of game instructions identifiers from a labeled game element, and an updating module configured for adjusting the adjustable property being associated with the at least one detected game instructions identifier.

Optionally, the pawn further comprises a presentation unit configured for expressing at least one of the plurality of adjustable properties.

According to an aspect of some embodiments of the present invention there is provided a method for adjusting at least one property of a plaything. The method comprises hosting a plurality of game instructions identifiers on a memory of the plaything, each the game instructions identifier being associated an adjustment to a plaything property of the plaything, using the plaything for detecting at least one of the plurality of game instructions identifiers on at least one labeled game element, and applying the adjustment on a respective plaything property associated with the at least one detected game instructions identifier.

According to an aspect of some embodiments of the present invention there is provided a game management apparatus for managing an interactive game with at least one player. The game management apparatus comprises a reading unit configured for reading a plurality of game related information identifiers from a plurality of labeled game elements, a memory for hosting a game status, a managing module configured for adjusting the game status according to at least one of the plurality of game related information identifiers, and a presentation unit configured for presenting at least one game instruction to the at least one player, the at least one game instruction being selected according to the adjusted game status.

Optionally, the game management apparatus further comprises an additional reading unit configured for reading the plurality of game related information identifiers, the managing module being configured for adjusting the game status according to reading of the reading unit and the additional reading unit.

According to an aspect of some embodiments of the present invention there is provided a game kit for a game that requires the arrangement of a number of game elements, comprising. The game kit comprises a plurality of game elements each having a part of a visual representation and a part of unique machine-readable representation, the plurality of game elements being configured to be arranged to form the visual representation and the unique machine-readable representation simultaneously and a sensing unit configured for identifying the unique machine-readable representation.

Optionally, the game kit further comprises a presentation unit configured for indicating whether the plurality of game elements being arranged to form the visual representation according to the identification.

Optionally, the visual representation is selected from a group consisting of: a two dimensional (2D) representation and a three dimensional (3D) representation.

Optionally, the visual representation is a picture and each the game element being a jigsaw puzzle element.

Optionally, the machine-readable representation is selected from a group consisting of: invisible to a human eye machine-readable representation and a semi-visible to a human eye machine-readable representation.

Unless otherwise defined, all technical and/or scientific terms used herein have the same meaning as commonly understood by one of ordinary skill in the art to which the invention pertains. Although methods and materials similar or equivalent to those described herein can be used in the practice or testing of embodiments of the invention, exemplary methods and/or materials are described below. In case of conflict, the patent specification, including definitions, will control. In addition, the materials, methods, and examples are illustrative only and are not intended to be necessarily limiting.

Implementation of the method and/or system of embodiments of the invention can involve performing or completing selected tasks manually, automatically, or a combination thereof. Moreover, according to actual instrumentation and equipment of embodiments of the method and/or system of the invention, several selected tasks could be implemented by hardware, by software or by firmware or by a combination thereof using an operating system.

For example, hardware for performing selected tasks according to embodiments of the invention could be implemented as a chip or a circuit. As software, selected tasks according to embodiments of the invention could be implemented as a plurality of software instructions being executed by a computer using any suitable operating system. In an exemplary embodiment of the invention, one or more tasks according to exemplary embodiments of method and/or system as described herein are performed by a data processor, such as a computing platform for executing a plurality of instructions. Optionally, the data processor includes a volatile memory for storing instructions and/or data and/or a non-volatile storage, for example, a magnetic hard-disk and/or removable media, for storing instructions and/or data. Optionally, a network connection is provided as well. A display and/or a player input device such as a keyboard or mouse are optionally provided as well.

BRIEF DESCRIPTION OF THE DRAWINGS

Some embodiments of the invention are herein described, by way of example only, with reference to the accompanying drawings. With specific reference now to the drawings in detail, it is stressed that the particulars shown are by way of example and for purposes of illustrative discussion of embodiments of the invention. In this regard, the description taken with the drawings makes apparent to those skilled in the art how embodiments of the invention may be practiced.

In the drawings.

DESCRIPTION OF SPECIFIC EMBODIMENTS OF THE INVENTION

Figure 1:
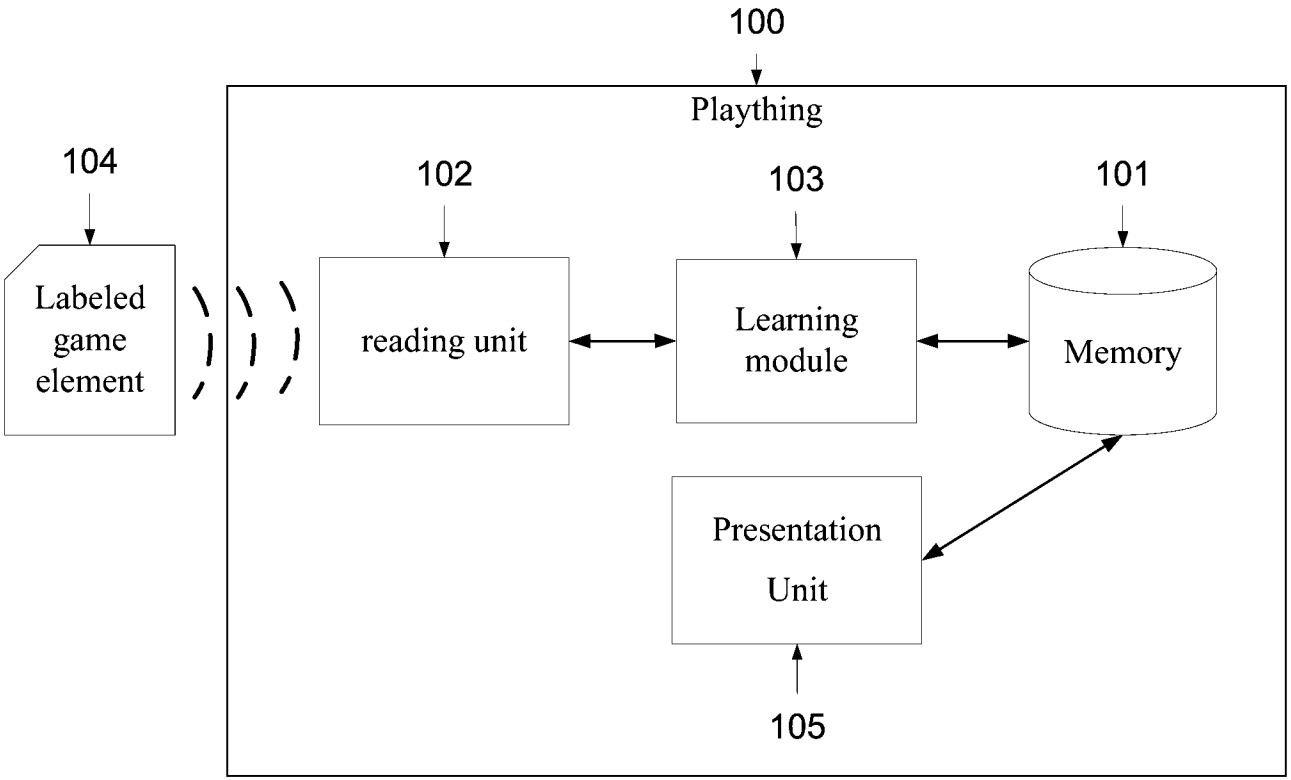
FIG. 1 is a schematic illustration of a plaything having one or more game attributes which can be adjusted using labeled game elements, according to some embodiments of the present invention.

The present invention, in some embodiments thereof, relates to a plaything and a method for using labeled game elements and, more particularly, but not exclusively, to a plaything and a method for using labeled game elements in interactive game.

According to some embodiments of the present invention there is a plaything, such as a pawn, a doll like toy, or a game console for managing an interactive game and/or to update one or more game attributes according to game elements with machine readable labels, such as labeled cards and labeled plastic elements. In some embodiment of the present invention, the plaything has a presentation unit that is used for expressing a progress in the managed game and/or the updated attributes. The presentation unit optionally uses a screen, a set of light emitting diode (LEDs), and/or one or more speakers to express the aforementioned game process and/or updated attributes. Such a plaything may be an interactive pawn in a multi-player game. In such an embodiment, the pawn has attributes which can be adjusted by the reading of one or more of the aforementioned labeled game elements. The plaything may be a game manager that follows the progress of a game by updating a game status according to the machine-readable representations it reads from the aforementioned labeled game elements.

In some embodiments of the present invention there is provided a plaything having adjustable game attributes. The plaything comprises a reading unit, such as a color sensor, for reading a unique machine-readable representation of game related information from a labeled game element and a memory for hosting an attribute record characterizing at least one game attribute of a game. The plaything further comprises a learning module for updating the attribute record according to the game related information and a presentation unit for expressing the game attributes according to the updated attribute record.

In some embodiments of the present invention there is provided a game management apparatus for managing an interactive game with one or more players. The game management apparatus includes a reading unit for reading game related information identifiers from a plurality of labeled game elements, a memory for hosting a game status, and a managing module for adjusting the game status according to one or more of the plurality of game related information identifiers. The game management apparatus further comprises a presentation unit for presenting one or more game instructions to the player. The game instructions are defined according to the adjusted game status.

In some embodiments of the present invention there is provided a game kit for a game, such as a jigsaw puzzle, that requires the arrangement of a number of game elements. The kit comprises a number of game elements; each having a part of a visual representation, such as jigsaw puzzle elements, and a part of unique machine-readable representation. The part of unique machine-readable representation may be invisible, semi-visible, or visible to a human eye. The game elements are designed to be arranged to form the visual representation, for example a picture or any other image, and the machine-readable representation simultaneously. The game kit further comprises a sensing unit for identifying the unique machine-readable representation and optionally a presentation unit for indicating to the player that the game elements are arranged to form the visual representation according to the identification. For example, presentation unit may be designed to notify the player that the jigsaw puzzle elements are arranged accurately to form a predefined image or a predefined picture.

Before explaining at least one embodiment of the invention in detail, it is to be understood that the invention is not necessarily limited in its application to the details of construction and the arrangement of the components and/or methods set forth in the following description and/or illustrated in the drawings and/or the examples. The invention is capable of other embodiments or of being practiced or carried out in various ways.

Reference is now made to FIG. 1, which is a schematic illustration of a plaything 100 having one or more game attributes which can be adjusted using labeled game elements, such as labeled game cards, labeled stickers, labeled positions in a board game, labeled plastic blocks, and labeled board game pawns, according to some embodiments of the present invention. The plaything 100, which is optionally a handheld plaything having a housing in the form of a person, an animal, and/or a game pawn, comprises a memory 101 for hosting a number of attribute records. Each one of the attribute records characterizes one or more game attributes of the handheld plaything 100. As used herein, a game attribute or a game action means an action, a reaction, a behavior, an attitude, and/or a posture of the plaything 100. For example, a game attribute or a game action may be a reaction of the plaything 100 to one or more instructions which are received from a player, a computing unit, such as a personal computer or a personal digital assistant (PDA) that communicates with the plaything, and/or another plaything. Optionally, a game attribute can be represented as a value having an adjustable intensity such as the power and/or the ability of an imaginary character, such as a RPG character, which is represented by the plaything 100. Optionally, the adjustable property defines the manner of communicating with a player, a computing unit, and/or another plaything.

The plaything 100 further comprises a reading unit 102 which is used for detecting one or more game related identifiers on a labeled game element 104 and a learning module 103 for adjusting the adjustable property that is associated with the detected game related identifiers. As used herein, a game related identifier means a unique machine readable representation of game related information, such as a code or a sign that is uniquely assigned to a set of one or more game instructions. A game related identifier may be a barcode, a mark, a watermark, a symbol, and/or a coded label, for example as described in U.S. Patent Application No. 2006/0259314, published on Nov. 16, 2006, which is incorporated herein by reference. The game related identifier may be visible, invisible, or partly visible to the casual viewer. As used herein, a labeled game element 104 means a virtual element and/or a physical element that includes one or more game related identifiers and represents game related information to the player. A virtual element may be an icon or any other displayable graphical element that is displayed on a screen, for example a screen a computing unit such as a personal computer or a PDA. A physical element may be a card, such as a plastic card, a cardboard card, a metal card, a game pawn, a game element, a POG like element and/or any other separable labeled game element 104 that includes one or more game related identifiers and represents game related information.

Optionally, the labeled game element 104 has a player identifiable indication for indicating to the player which game related information is embodied in the game related identifier that is attached thereto, for example which change the labeled game element has to a game status that is monitored by the plaything. For clarity, as used herein attached to the labeled game element 104 means printed, adhered, laminated, and/or molded to the body of the labeled game element 104.

In one exemplary embodiment, all the components of the plaything 100 are placed within and/or disposed on a housing that is shaped as a human, an object, an animal and/or a pawn. In such an embodiment, the plaything 100 may simulate a human behavior or function as an interactive pawn in a multiplayer game, such as a role-playing game (RPG).

Figure 2:
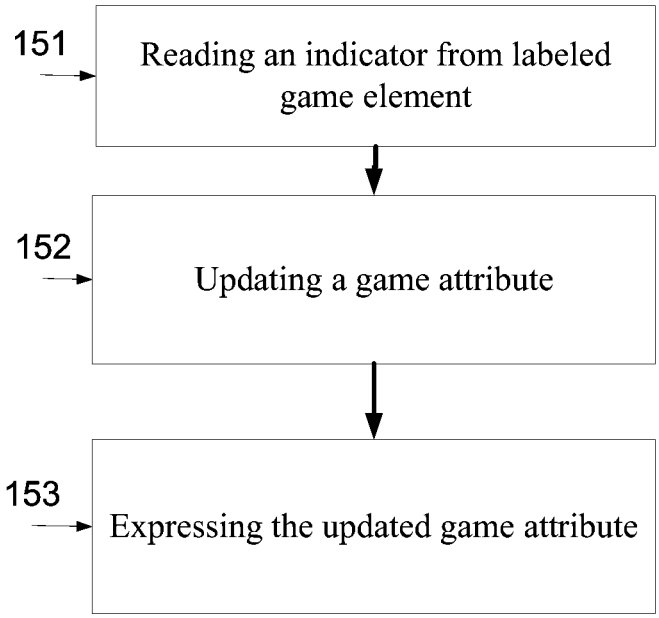
FIG. 2 is a flowchart of a method for using a labeled game element for updating one or more game attributes, according to some embodiments of the present inventions.

Reference is now also made to FIG. 2, which is a flowchart of a method for using a labeled game element for updating one or more game attributes which are documented in memory 101 of the plaything 100, according to some embodiments of the present inventions. First, as shown at 151, the plaything 100 is used for reading one or more game related identifiers from a labeled game element, such as shown at 104. In such an embodiment, the game related identifier is a unique machine-readable representation of game related information that characterizes one or more game attributes, such as game actions of the handheld plaything and/or attributes of a virtual character that is represented by the plaything 100, for example an adjustment to one or more of the reactions of the plaything 100 to the reading of other labeled game elements and/or actions of the player. Now, as shown at 152, an attribute record that stores information that characterizes the one or more game actions of the handheld plaything and/or other attributes thereof is updated according to the game related information that is associated with the game related identifier. In such a manner, one or more of the reactions and/or the functioning of the plaything 100 is adjusted according to the card elements 104 it reads. For example, after the plaything 100 reads a labeled game element with a game related identifier that represents a progress of the player in a certain game, an attribute record that stores information about the progress of the player in a certain game is updated. Then, as shown at 153, the plaything 100 expresses the updated game attribute. For example, the plaything 100 instructs the presentation unit 105 to perform a certain action, to react to a stimulating information or event in a certain manner, to turn on and/or off one or more LEDs, to notify the player that she has reached a stage in a multi-stage game, for example by playing a media file, to trigger an interactive session with the player, and the like.

The presentation unit 105 is used for expressing one or more of the aforementioned game attributes. Optionally, the presentation unit 105 includes a set of speakers, which is mounted on the housing of the plaything 100. In such an embodiment, the memory 101 hosts a number of audio files such as moving picture experts group (MPEG) Audio Layer-3 (MP3) files which are designed to be played, optionally as described below. Optionally, the presentation unit 105 includes a display such as a liquid crystal display (LCD) screen, which is mounted on the housing of the plaything 100. In such an embodiment, the memory 101 comprises video files such as moving picture experts group (MPEG) 1-4 files. The presentation unit 105 is designed for displaying the attribute records using the LCD screen and plays the audio stream thereof using the speakers. Optionally, the presentation unit 105 comprises one or more vibrating units. In such an embodiment, the memory 101 comprises instructions for the vibrating units. The presentation unit 105 activates the vibrating units according to the matching content attribute record when the related label is identified. The presenting of the content may be understood as playing an audio file, displaying a video file, displaying a text message, activating a vibrating unit, activating a light source or changing the color of light emitted therefrom, etc.

Optionally, the housing of the plaything 100 includes a head portion defining an opening for a mouth and two openings for eyes. Optionally, the presentation unit 105 comprises light emitting diodes (LEDs) and a speaker in electrical communication for emitting an audible sound are disposed in electrical communication with a microcontroller that is disposed within the doll. The LEDs and the speaker are disposed within the head portion respectively in alignment with the eye openings and the mouth opening. Optionally, the microcontroller is connected to a motion detection module that includes an accelerometer, a vibration sensor, and/or an image sensor and designed for detecting and measuring any displacement of the plaything 100. More optionally, the microcontroller is connected to a repository that hosts one or more attribute records. In such an embodiment, the attribute record comprises a number of recordings; each associated with a certain game related identifier and can be played as a reaction to a displacement of the plaything 100. Optionally, the attribute record comprises a set of instructions each used for controlling the intensity of the LED and/or turning it on or off. In such an embodiment, the instruction and/or recording are selected by the microcontroller in response to a certain displacement of the plaything 100. Optionally, the game related information that is coded in the game related identifier may also be the voice, the tone of the voice, and/or the volume which is used for playing the recording.

Optionally, the reading unit 102 includes a sensing unit for reading the game related identifiers. As used herein, a sensing unit means a photoelectric sensor, an image sensor, a color sensor, an infrared (IR) sensor or any other sensor that is designed for reading labels with unique patterns. Optionally, the sensing unit is as disclosed in U.S. Provisional Patent Application No. 60/906,228, filed on Mar. 12, 2007 and U.S. Provisional Patent Application No. 60/906,227, filed on Mar. 12, 2007, which are herein disclosed by reference.

Figure 3:
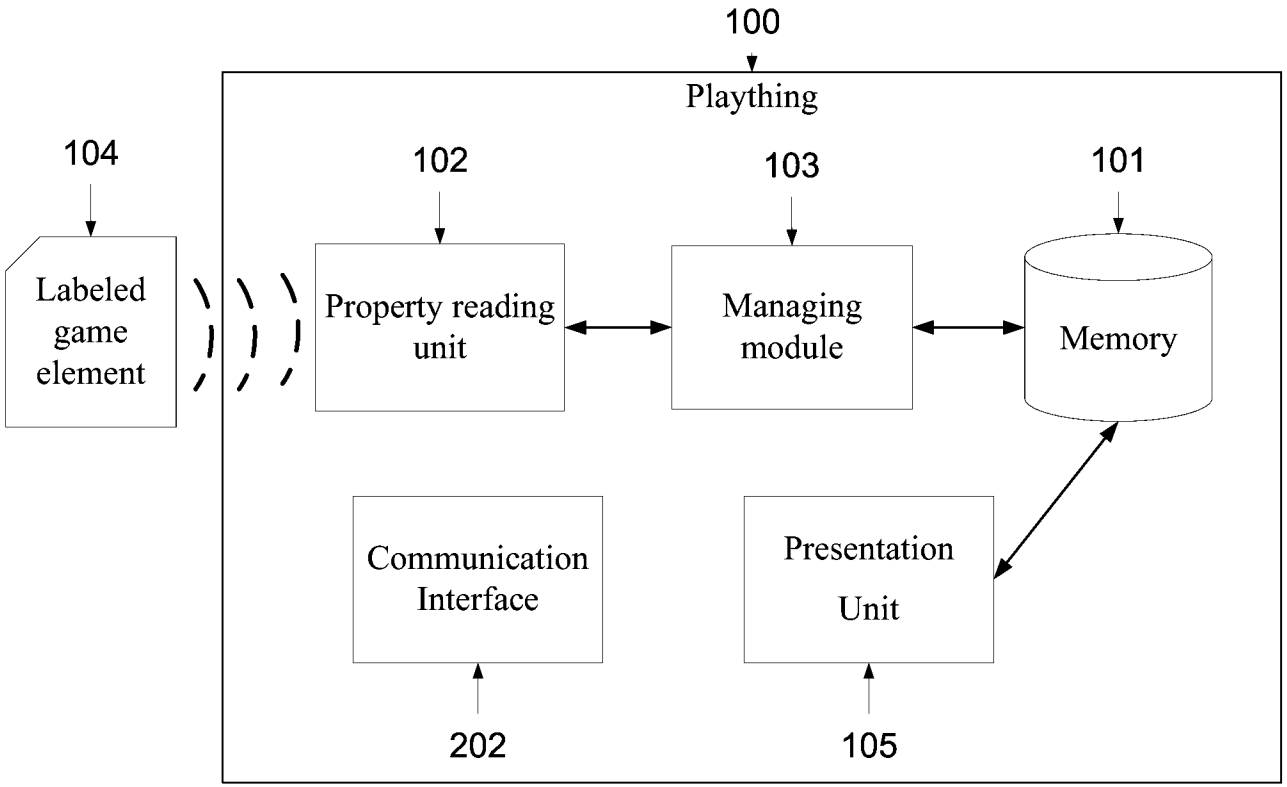
FIG. 3 is a schematic illustration of a plaything, according to some embodiments of the present invention.

Reference is now made to FIG. 3, which is a schematic illustration of a plaything 100, according to some embodiments of the present invention. The reading unit 102, the learning module 103, the presentation unit 105 and the memory 101 are as depicted in FIG. 1. However, FIG. 3 further depicts a communication interface 202. Optionally, the communication interface 202 allows the plaything 100 to communicate with a computing unit (not shown), such as a laptop or notebook computer, a desktop computer, and a personal digital assistant (PDA). The communication interface 202 may comprise a wired interface, such as a universal serial bus (USB) interface, a FireWire™ interface, or a wireless interface, such as a wireless local area network (WLAN) interface, a radio communication which is based on Bluetooth™ protocol, Wi-Fi™ protocol, a Wi-Max™ protocol, or industrial, scientific, and medical (ISM) bands, Optionally as defined by the ITU-R in 5.138 and 5.150 of the Radio Regulations, which are herein incorporated by reference.

As described above, the learning module 103 is designed for updating one or more game attributes which is associated with game related identifiers, such as labels, which are printed and/or attached to cards. In such an embodiment, the adjustable properties may include the manner the plaything 100 communicates with the computing unit or the ability of the plaything 100 to communicate with the computing unit. For example, the adjustable properties may include the manner the plaything 100 communicates with a computing unit or reacts to transmissions thereof, for example as described in U.S. Pat. No. 6,022,273 filed on Nov. 20, 1997, which is incorporated herein by reference.

Optionally, the reading unit 102 is designed for detecting a game related identifier, such as a label, that is printed on a card and represents one or more unique values and/or attribute records which are stored in the memory 101. In such an embodiment, each unique value is associated with an attribute record that includes a set of instructions or a media file which is adjusted to be presented by the presentation unit 105, optionally as described above. Optionally, the attribute record defines a reaction to the computing unit or a manner of communication therewith. The learning module 103 associates between the unique value and one or more new attribute records which are represented by the game related identifier. Such an association changes the manner the plaything 100 reacts and/or communicates with the communication unit.

Optionally, the communication interface 202 allows the plaything 100 to communicate with one or more other playthings. Optionally, the communication interface 202 comprises a short-range radio communication interface 202, an Infrared communication interface 202, a Bluetooth® communication interface 202, an Ultrasonic communication interface 202, sonic communication interface 202, and the like for establishing communication with the one or more other playthings.

Optionally, each one of the playthings simulates a certain virtual figure. In such an embodiment, the playthings are used for simulating an interaction between two or more virtual figures, where each plaything 100 simulates a virtual figure that reacts to the presence of another virtual figure. For example, a first plaything 100 may use its communication interface 202 for detecting the presence of a second plaything 100.

In such an embodiment, the communication interface 202 of the plaything 100 may comprise a transmitter for allowing sending messages and presence notifications to the other plaything. When the presence of the second plaything is detected, the first plaything 100 instructs the presentation unit 105 to present a designated content attribute record that simulates a reaction of a figure to the presence of another figure and sends an activation signal that is received at the communication unit of the second plaything. The second plaything reacts to the received activation signal by instructing its presentation unit 105 to present a designated content attribute record that simulates a reaction to the first plaything 100 and optionally sends a response signal to the first plaything 100. In such a manner, the first and the second playthings are used for entertaining the player by simulating a conversation or an interaction or for exhibit an outcome of a move or a sub-move in a game. For example, the two playthings may be used for presenting a conversation between two or more figures or a playing the same audio file in different voice tones. In such an embodiment, the game attributes include the manner the plaything 100 reacts to the presence of another plaything or communicate therewith.

Optionally, the communication interface 202 allows the plaything 100 to simulate a game and/or a fight with another plaything that has a communication interface. As described above, the game attributes may be the intensity of a certain attribute or a certain action. Optionally, the playthings simulate a combat and the plaything that has one or more game attributes that represent higher power wins. In such an embodiment, at least one of the playthings comprises a virtual combat module for managing the simulated combat. Optionally, the outcome of each session is based on the intensity of attributes which are documented in the memory 101 of each plaything, for example 100. For example, the plaything may read a label game element with a game related identifier that represents a certain armament which is optionally weighted. The certain armament is uploaded to the memory 101 of the plaything, optionally as described above, and the virtual combat module considers the uploading during each session. Optionally, the uploaded armament is weighted. The virtual combat module is optionally designed for determining an outcome of a session which is based on the uploaded armament of each one of them, optionally using a generated random number. For clarity, the virtual combat module is an exemplary module and any other module for managing a game, optionally a multi player game, such as a trading game, a relationship game, and/or any other simulation game may be used.

Optionally, each card represents an action the player wants to make for the following session of the game. For example, when the virtual combat module is used, the player attacks by using the plaything for reading one or more attack cards and/or one or more defense cards, optionally in a certain sequence. Certain cards may only be used a limited number of times as attack and/or defense cards and the plaything 100 counts the number of times they have been used. Each card has a range of possible effects in the outcome of the session that is determined by the virtual combat manager that determines who won the session. Optionally, in each session, the power of a certain plaything decreases if the other plaything succeeds in a virtual attack. Optionally, if the attack is successful, the loser gets a chance to defend itself in an additional session.

Figure 4:
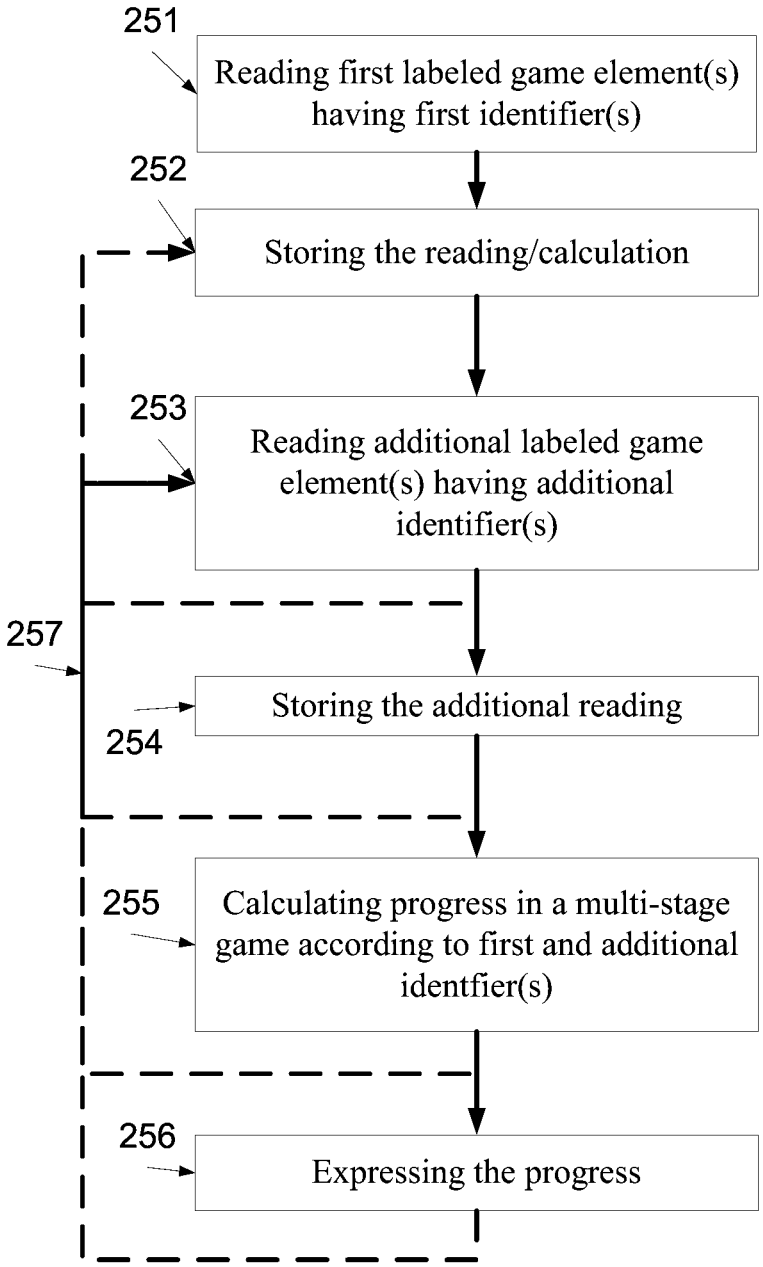
FIG. 4 is a flowchart of a method for managing a game with a number of labeled game elements, according to some embodiments of the present invention.

Reference is now also made to FIG. 4, which is a flowchart of a method for managing a game with a number of labeled game elements, according to some embodiments of the present invention. First, as shown at 251, the plaything 100 is used for reading one or more game related identifiers from one or more game elements. In such an embodiment, the game related identifier is a unique machine-readable representation of a set of instructions that represents a stage, a sub stage, and/or a progress in an interactive game. Then, as shown at 252, the reading of the one or more game related identifiers is stored in the memory of the plaything 101, allowing the player to play a multi stage game, optionally as described in 253-257. Now as shown at 253, the plaything 100 is used for reading one or more additional game related identifiers from one or more additional labeled game elements. For example, after the plaything 100 has been used for reading a game related identifier from the label of a labeled game card, as shown at 251, 252, the plaything 100 is used for reading another labeled game card. Then, optionally, as shown at 254, the plaything 100 is used for storing the reading of the additional game related identifier. Now, as shown at 255, the progress of a multi-stage game is calculated according to the reading of 251 and 253. The calculation is then expressed, optionally using the presentation unit 105, as shown at 256. It should be noted that additional game related identifiers can be read from any number of game elements, optionally in a sequential manner, as shown at 257. In such an embodiment, the plaything 100 may sequentially read two or more labeled game cards and may present an outcome of the reading to the player. Optionally, the labels are as described in U.S. Patent Application No. 2006/0259314, published on Nov. 16, 2006, which is herein incorporated herein by reference.

In one embodiment of the present invention, the plaything 100 is used for managing a game in which labeled game elements have to be arranged in a logical order. Optionally, the logical order is a story that is presented to the player, optionally by the presentation unit 105 of the plaything 100, or given in a book. The plaything 100 optionally expresses the progress of the player in the game, as shown at 256, by notifying him whether a set of labeled card games are read in the correct order by the plaything 100. The notification may be presented by playing a media file that is related to the labeled game card or by announcing messages such as 'right', 'wrong', 'congratulation' and/or 'try again'.

Optionally, the plaything 100 further comprises a timing module which is designed for measuring time between the readings of the game related identifiers. In such a manner, the plaything 100 can be used for measuring time between different player actions and reactions. Optionally, the timing module is designed to instruct the presentation unit 105 to present the time that elapsed after a certain action or reaction or the time that left for performing a certain action.

Figure 5A:
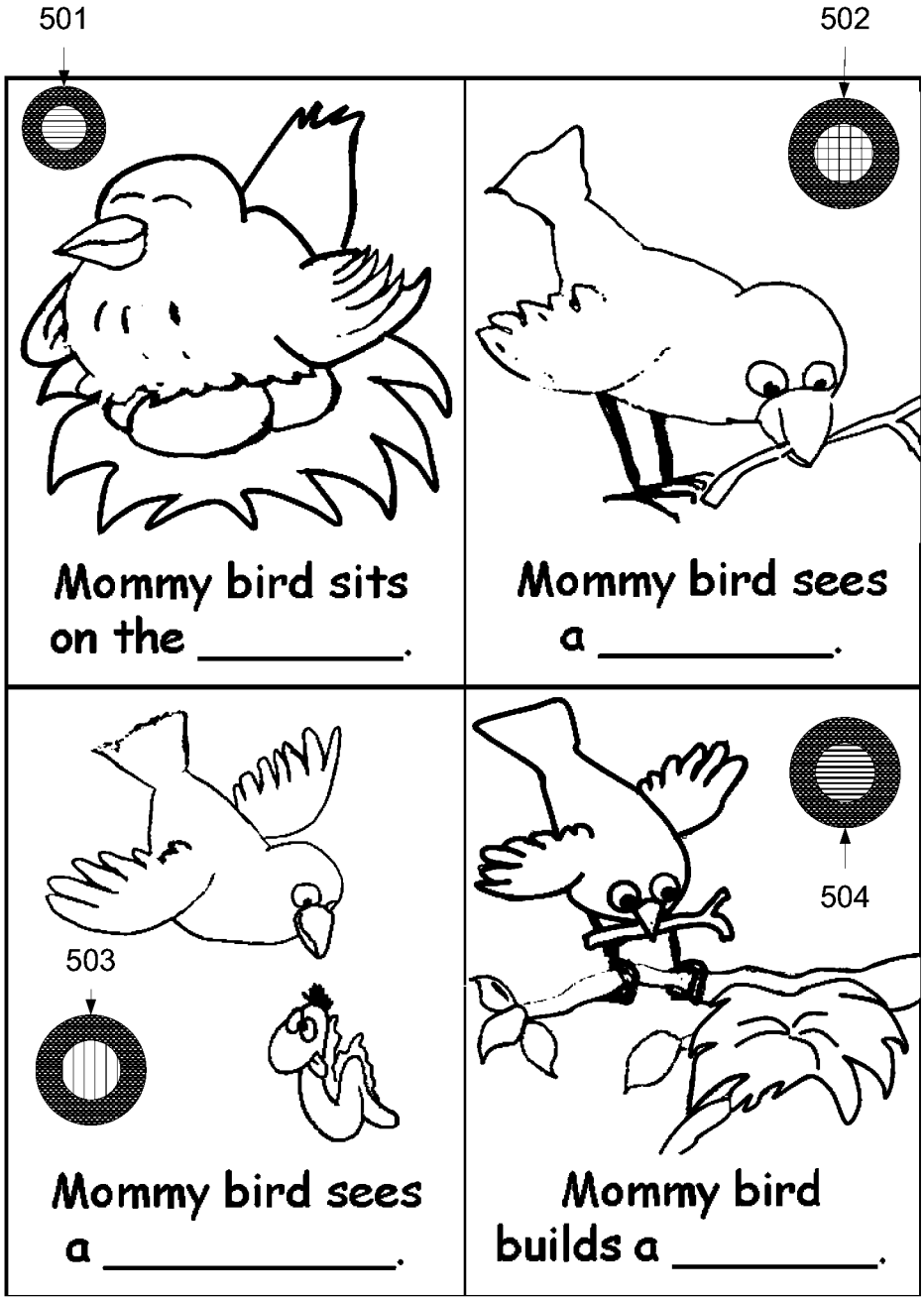
FIG. 5A is a schematic illustration of a set of four cards that depicts four different scenes from a poem and/or a story, according to some embodiments of the present invention.

Reference is now also made to FIG. 5A, which is a schematic illustration of a set of four labeled game cards that depicts four different scenes from a poem and/or a story, according to some embodiments of the present invention. Optionally, the plaything 100 is used for managing a memory game in which a story and/or a poem is played and/or for allowing the player to use the plaything 100 to read card elements that depict sections of the story and/or the poem in the same order as they appeared in the story and/or the poem. Such a plaything 100 gives the player the chance to demonstrate and to reinforce her recollection of the story. For example, the set of four labeled game cards which are depicted in FIG. 5A are printed, tagged, and/or attached with game related identifiers 501-504. Each game related identifier is a unique machine-readable representation of a set of instructions that represents the place of the scene among the cards which are depicted in FIG. 5A and optionally the story that they are taken from. In such an embodiment, the plaything 100 may be used for allowing the player to order labeled game elements of a number of different stories and/or poems.

Figure 5B:
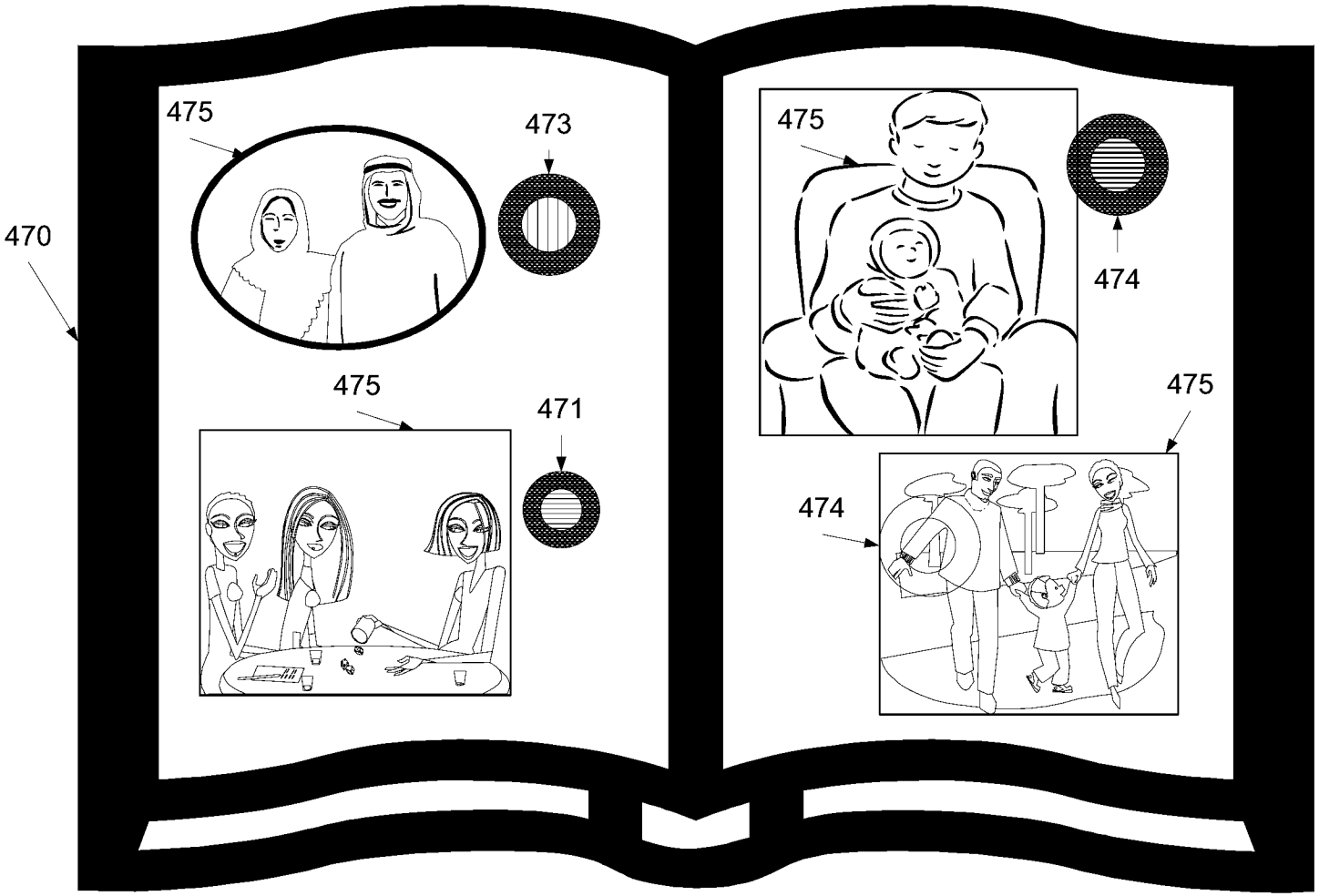
FIG. 5B is a schematic illustration of pages of a photo album that depicts four photos, according to some embodiments of the present invention.

Reference is now also made to FIG. 5B, which is a schematic illustration of pages of a photo album 470 having different photos 475, according to some embodiments of the present invention. Optionally, the plaything 100 is used for enhancing the experience of watching a photo album having a plurality of photos by allowing the user to use the plaything 100 to read photo related identifiers 471-474 which are associated with various any of the plurality of photos. Each photo related identifier is a unique machine-readable representation of a media record that is positioned in a proximity to a receptive photo in of the photo album. The reading triggers the playing of media content, such as a story, a music segment, a vocal title, and/or any audible content, that is related to the associated photo. Optionally, the plaything 100 allows the user to record and/or to upload the media content and associate it with one or more of photo related identifiers. Optionally, the plaything 100 comprises a microphone for allowing the user to record media content and a man machine interface (MMI) for allowing the user to associate a photo related identifier with the recorded record media content. For example, the MMI may include a "record" button and "mark photo" button. The MMI may trigger the recording of media content when the user presses the "record" button and the association with the photo related identifier that is red by the plaything 100 when the user presses the "mark photo" button. Optionally, the plaything 100 uses the communication interface 202 for interfacing with a software module that is used for associating between photos and photo related identifiers. In use, the user may use the module, which is optionally executed on a computing unit, such as a laptop or a personal computer, for associating between media content and photo related identifiers. The associations and the media content are uploaded via the communication interface 202 and stored in the memory 101. In use, the user uses the plaything 100 to read the photo related identifiers and respectively play the associated media content from the memory 101. In such a manner, the user may prepare an interactive photo album that plays media content, such as a description, a photo summary, background music, and sound that has been recorded when the image was taken, when the user uses the plaything to read photo related identifiers. Optionally, the photo related identifiers are patterns of unique features in the photos. In such an embodiment, the user may use the plaything 100 for recording the patterns by reading a portion of the photo, for example as shown at 474. In such a manner, additional photo related identifiers may not be added to the photo album itself. It should be noted that reading patterns from images, such as photos is known in the art and therefore not further elaborated herein.

Optionally, the memory 101 comprises a memory card reader for reading content that is stored in memory cards. The memory cards are optionally solid-state electronic flash memory data storage devices, such as CompactFlash™ cards, SmartMedia™ cards, Memory Stick™ cards, Secure Digital™ cards, miniSD™ cards, and/or MicroSD™ cards. Optionally, the memory card reader allows the updating records, such as the media content and/or the association thereof with the aforementioned photo related identifiers.

Figure 6:
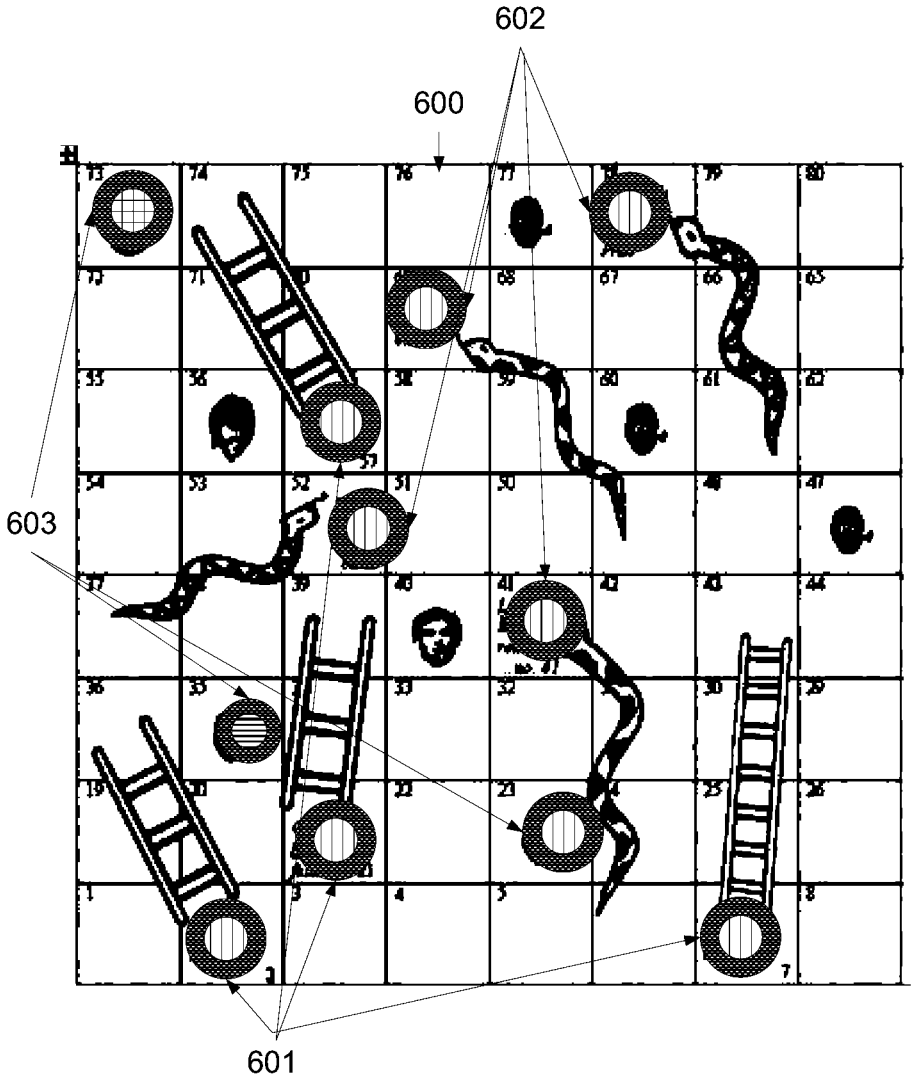
FIG. 6 is a 'snakes and ladders' board game having a number of labeled game elements as squares in the board, according to some embodiments of the present invention.
Figure 7:
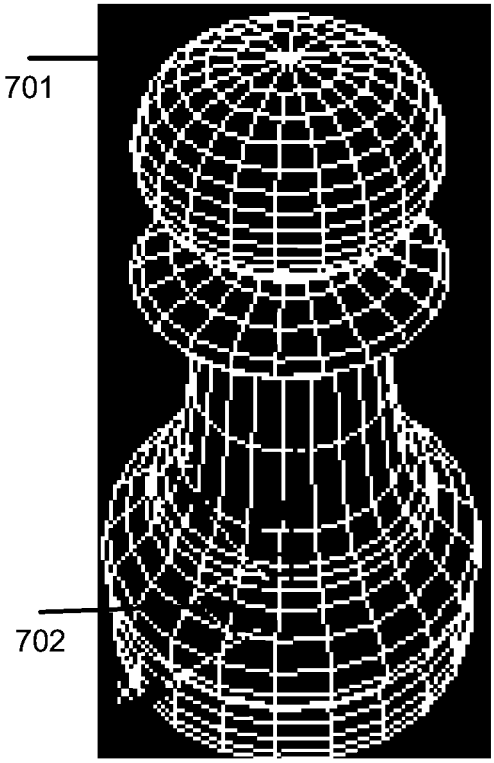
FIG. 7 is a schematic illustration of a pawn like housing for the plaything, according to some embodiments of the present invention.

Optionally, the plaything 100 is used for managing a game in which the labeled game elements have to be read in a predefined order, which may be fixed or dynamic. For example, FIG. 6 depicts a 'snakes and ladders' board game 600 having a number of labeled game elements as squares in the board, for example as shown at 601-603, according to some embodiments of the present invention. In such an embodiment, the plaything 100 is used as a pawn in the 'ladders and snakes' board game 600. In such an embodiment, the plaything 100 optionally comprises a housing which is shaped as a pawn, for example as shown at 701 in FIG. 7, which is a schematic illustration of a pawn like housing for the plaything 100, according to some embodiments of the present invention. For allowing the pawn 100 to read the game related identifiers of the labeled game elements, the reading unit 102 of the pawn 100 includes a sensing unit with one or more sensors which are directed towards the basis thereof, for example at shown at 702. The basis of the pawn is designed to face the board, allowing the one or more sensors of the reading unit 102 to detect the game related identifier of the labeled game element that is positioned printed and/or attached to the square in which the pawn is placed. The pawn 100 tracks the progress of the game as it tracks the order in which the game related identifiers are read. It should be noted that the order may dynamically change as the pawn may be repositioned during the game, for example according to the reading of a game related identifier that is associated with a certain ladder and/or a certain snake. Optionally, at least some of the game related identifiers of labeled game elements of the board are associated with a media file and/or a set of instructions which are executed when the game related identifier is read, optionally in the light of the detected reading order. In such a manner, the pawn 100 may express the progress of the game, enrich the player experience with an interactive layer, for example by playing a media file that describe the progress, and/or initiate a question and answer (Q&A) session with the player and to bind the progress of the game with the player response etc.

In one embodiment of the present invention, the plaything 100 is used for managing a multi stage game in which certain labeled game cards have to be read using the plaything before the player is allowed to progress in the game. In such an embodiment, the plaything 100 stores information about the game related identifiers of the labeled game elements that have been read by the plaything 100 and allows the player to progress after the stored information fulfills predefined requirements, such as a list of game related identifiers which have to be detected by the plaything and a number of different game related identifiers which have to be detected by the plaything. For example, the plaything 100 may be a pawn that embodies a virtual character in a RPG and the progress of the virtual character depends on the labeled game elements that have been read by the plaything 100, as described above. Optionally, each labeled game element is associated with a certain number of points and the plaything sums the points which are associated with the game related identifiers it reads.

Figure 8:
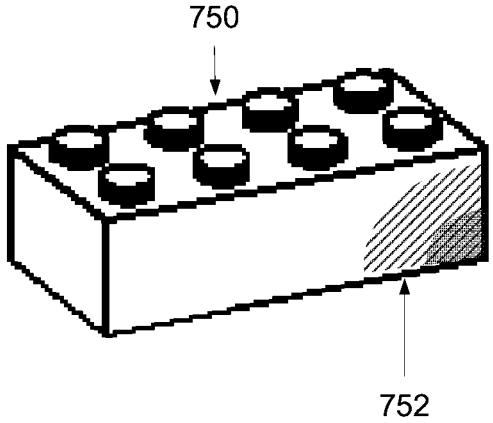
FIG. 8 is a schematic illustration of a labeled game element which is a block that is designed to be fastened together with other blocks to create a game related identifier.
Figure 9:
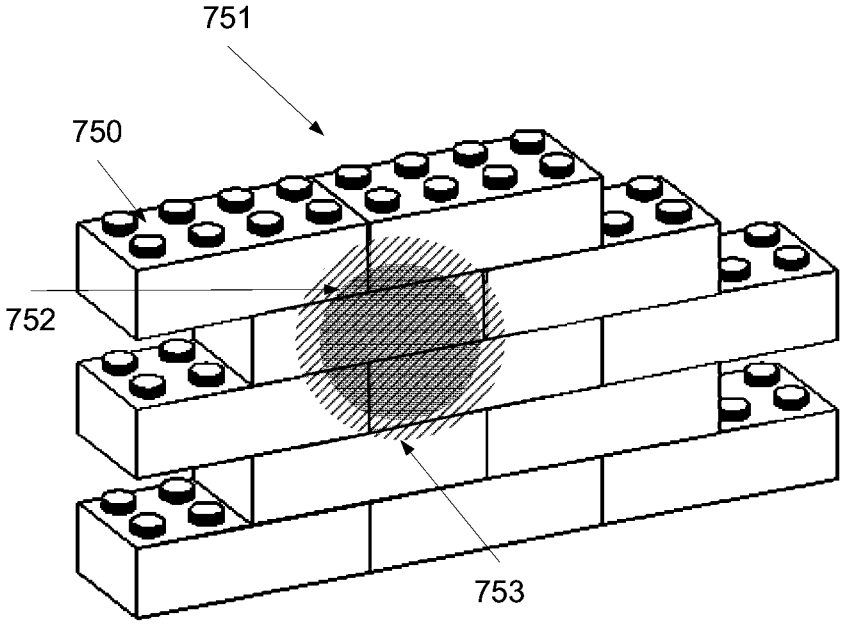
FIG. 9 is a wall of blocks, such as the block depicted in FIG. 8, according to some embodiment of the present invention.

Reference is now also made to FIG. 8, which is a schematic illustration of a labeled game element, which is a block 750 that may be fastened together with other blocks to create a game related identifier, and to FIG. 9, which is a wall of blocks 751, such as the block 750 that is depicted in FIG. 8, according to some embodiment of the present invention. FIG. 9 illustrates how a number of labeled game elements can be placed to form a combined game related identifier.

Optionally, the labeled game elements are designed to be combined to form a combined game related identifier. Optionally, as depicted in FIGS. 8 and 9, the labeled game elements are blocks which are designed to be fastened together to create different shapes. Optionally, each one of the labeled game elements is a Lego™ shaped plastic element. Optionally, each one of the labeled game elements includes part of a certain game related identifier, for example as shown at 752. In such an embodiment, the plaything may be used to verify whether the player fastens and/or positions a set of labeled game elements in a logical two dimensional (2D) and/or three dimensioned (3D) structure.

In particular, the fastening of the labeled game elements, optionally as shown at FIG. 9, or the positioning thereof in a certain arrangement creates a combined game related identifier, optionally as shown at 753. The plaything 100, which is designed to detect game related identifiers such as the combined game related identifier, optionally as described above, is designed for identifying whether the parts of a certain game related identifier are arranged in a proper manner or not and optionally for playing a notice for indicating that. The parts of a certain game related identifier are optionally attached or printed on the set of labeled game elements in a manner that they are combined as the certain game related identifier only when the labeled game elements are arranged to form a predefined logical structure. Optionally, a number of combined game related identifiers are formed when the labeled game elements are arranged in the predefined logical structure. The combined game related identifiers are visible, semi visible, or invisible to a human eye. An example for an invisible combined game related identifier is an identifier which is designed to be detected by an infrared sensor.

Optionally, each one of the labeled game elements is a jigsaw puzzle element. In such an embodiment, the plaything 100, which is designed for detecting the combined game related identifier, can be used for determining whether a jigsaw puzzle, which is combined from a plurality of labeled game elements, or a portion thereof, is completed or not. Optionally, each jigsaw puzzle comprises a set of labeled game elements each with a visible, semi visible or invisible part of one or more game related identifiers. When a members of the set are to be fitted together to form picture and/or a portion of a picture, the plaything 100 is used detecting the one or more game related identifiers, thereby determine whether the members of the set have been accurately fitted together or not.

Figure 10:
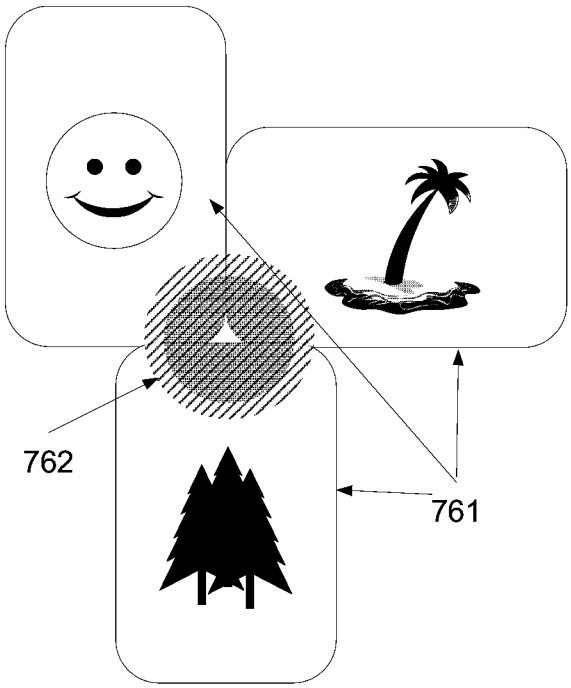
FIG. 10 is a schematic illustration of three cards which are arranged to combine a certain game related identifier, according to some embodiments of the present invention.

Optionally, the labeled game elements are labeled game cards and the positioning thereof in a certain arrangement creates a combined game related identifier, for example as shown at FIG. 10, which is a schematic illustration of three cards 761 which are placed to form a combined game related identifier 762, according to some embodiments of the present invention.

Figure 11:
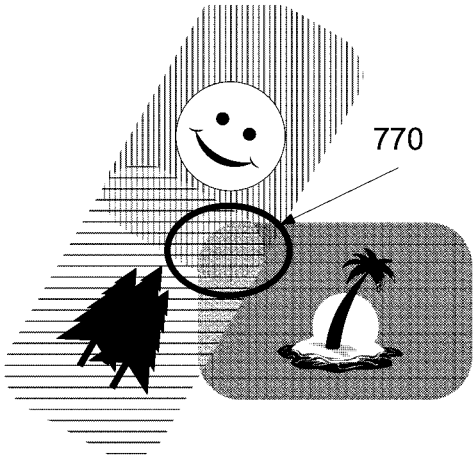
FIG. 11 is a schematic illustration of three semi-transparent cards, according to some embodiments of the present invention.

Optionally, the game related identifier is the color of the labeled game element. In such an embodiment, the combined game related identifier has a number of colors. Optionally, at least one of the labeled game elements is perforated, transparent, semi- and/or transparent. In such an embodiment, one labeled game element can be positioned in front of another labeled game element, thereby to create a unique combined game related identifier, for example as shown at 770 of FIG. 11, which is a schematic illustration of three semi transparent cards, according to some embodiments of the present invention. Optionally, one or more of the labeled game elements are perforated. In such an embodiment, the positioning of one labeled game element in front of another labeled game element creates a combined game related identifier that is optionally associated with a attribute record that reflect the combination of the related labeled game elements.

In one embodiment of the present invention, the plaything 100 functions as a console 100 for managing a game that is based on labeled game elements, such as game cards. Optionally, the reading unit 102 of the console 100 comprises two or more sensing units, allowing the reading of a respective number of game related identifiers simultaneously or substantially simultaneously. In such an embodiment, the console 100 may manage a multiplayer game. Each one of the sensing unit may be used for reading labeled game elements which are placed in front of it by a different player.

It is expected that during the life of a patent maturing from this application many relevant apparatuses and methods will be developed and the scope of the term sensor, memory, cards, game elements, and displays are intended to include all such new technologies a priori.

As used herein the term "about" refers to ±10%

The terms "comprises", "comprising", "includes", "including", "having" and their conjugates mean "including but not limited to".

The term "consisting of means "including and limited to".

The term "consisting essentially of" means that the composition, method or structure may include additional ingredients, steps and/or parts, but only if the additional ingredients, steps and/or parts do not materially alter the basic and novel attributes of the claimed composition, method or structure.

As used herein, the singular form "a", "an" and "the" include plural references unless the context clearly dictates otherwise. For example, the term "a compound" or "at least one compound" may include a plurality of compounds, including mixtures thereof.

Throughout this application, various embodiments of this invention may be presented in a range format. It should be understood that the description in range format is merely for convenience and brevity and should not be construed as an inflexible limitation on the scope of the invention. Accordingly, the description of a range should be considered to have specifically disclosed all the possible subranges as well as individual numerical values within that range. For example, description of a range such as from 1 to 6 should be considered to have specifically disclosed subranges such as from 1 to 3, from 1 to 4, from 1 to 5, from 2 to 4, from 2 to 6, from 3 to 6 etc., as well as individual numbers within that range, for example, 1, 2, 3, 4, 5, and 6. This applies regardless of the breadth of the range. Whenever a numerical range is indicated herein, it is meant to include any cited numeral (fractional or integral) within the indicated range. The phrases "ranging/ranges between" a first indicate number and a second indicate number and "ranging/ranges from" a first indicate number "to" a second indicate number are used herein interchangeably and are meant to include the first and second indicated numbers and all the fractional and integral numerals therebetween.

It is appreciated that certain features of the invention, which are, for clarity, described in the context of separate embodiments, may also be provided in combination in a single embodiment. Conversely, various features of the invention, which are, for brevity, described in the context of a single embodiment, may also be provided separately or in any suitable subcombination or as suitable in any other described embodiment of the invention. Certain features described in the context of various embodiments are not to be considered essential features of those embodiments, unless the embodiment is inoperative without those elements.

Although the invention has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims.

All publications, patents and patent applications mentioned in this specification are herein incorporated in their entirety by reference into the specification, to the same extent as if each individual publication, patent or patent application was specifically and individually indicated to be incorporated herein by reference. In addition, citation or identification of any reference in this application shall not be construed as an admission that such reference is available as prior art to the present invention. To the extent that section headings are used, they should not be construed as necessarily limiting.

What is claimed is:

1. A handheld plaything having one or more adjustable game attributes, comprising:

a housing;

a reading unit located in said housing and reads any of a plurality of unique visual machine-readable representations from any of a plurality of labeled game elements, each said visual machine-readable representation encodes a different game related information;

a memory located in said housing and hosts at least one attribute record characterizing at least one game attribute of a game;

a learning module located in said housing and updates said at least one attribute record according to a respective said game related information encoded in at least one of said plurality of unique visual machine-readable representations which are read by said reading unit; and a presentation unit which expresses said game attribute according to said at least one updated attribute record;

wherein said reading unit based handheld plaything is a pawn indicating at least one of a character having at least one property in a multiplayer game and a progress of a player in a multi-stage game, said game related information being associated with an indication to at least one of a change in said property and a stage in said multi-stage game, said at least one game attribute defines at least one of a current level of said property and said progress.

2. The handheld plaything of claim 1, wherein said game attribute is selected from a group consisting of: an action of said handheld plaything, a reaction of said plaything to an action of a player, a reaction of said handheld plaything to said reading, a progress in said game, and a status of a player in said game.

3. The handheld plaything of claim 1, wherein said at least one attribute record is associated with a plurality of media records, said game related information being indicative of at least one of said plurality of media records, said presentation unit being performing said expressing by playing said at least one media record.

4. The handheld plaything of claim 1, wherein said labeled game element is selected from a group consisting of: a card, a plastic game element, a fastened plastic block, and a pawn.

5. The handheld plaything of claim 1, further comprising a communication interface for communicating with an additional plaything, said presentation unit being configured for performing said expressing in response said communication.

6. The handheld plaything of claim 1, further comprising a communication interface for communicating with a player, said presentation unit being configured for performing said expressing in response said communication.

7. The handheld plaything of claim 1, wherein said at least one attribute record records a development of a game played by a plurality of players, said game related information define an action taken by one of said plurality of players.

8. The handheld plaything of claim 1, wherein said learning module comprises a game management module configured for identifying a progress in said game according to said at least one updated attribute record, said presentation unit configured for expressing said progress.

9. The handheld plaything of claim 1, wherein said reading unit is configured for reading said plurality of unique visual machine-readable representations of game related information from at least one labeled game element.

10. The handheld plaything of claim 1, wherein said reading unit is configured for reading said plurality of unique visual machine-readable representations in an order, said order being indicative as said game related information.

11. The handheld plaything of claim 1, wherein said reading unit is configured for reading said unique visual machine-readable representation from a combination of a plurality of labeled game elements.

12. A method for managing a game, comprising:

a) allowing a player to use a reading unit based handheld plaything for reading a plurality of unique visual machine-readable representations of game related information from any of a plurality of labeled game element, each said visual machine-readable representation encodes a different game related information, wherein said reading unit is located in a housing;

b) updating in a memory located in said housing at least one game attribute being related to said player according to a respective said game related information encoded in at least one of said plurality of unique visual machine-readable representations which are read by said reading unit; and c) expressing said updated game attribute according to said update;

wherein said reading unit based handheld plaything is a pawn indicating at least one of a character having at least one property in a multiplayer game and a progress of a player in a multi-stage game, said game related information being associated with an indication to at least one of a change in said property and a stage in said multi-stage game, said at least one game attribute defines at least one of a current level of said property and said progress.

13. The method of claim 12, further comprising using said reader for reading at least one additional unique visual machine-readable representation of additional game related information and updating said at least one game attribute according to said additional game related information before c).

14. The method of claim 13, wherein said additional game related information is printed on an additional labeled game element.

15. The method of claim 12, wherein said at least one labeled game element comprises a plurality of labeled game elements.

16. The method of claim 15, further comprising providing said plurality of labeled game elements before said a), wherein each said labeled game element comprises a portion of said unique visual machine-readable representation.

17. A game management handheld apparatus for managing an interactive game with at least one player, comprising:

a housing;

a reading unit located in said housing and configured for reading any of a plurality of unique visual machine-readable representations from any of a plurality of labeled game elements, each said visual machine-readable representation encodes a different game related information;

a memory for hosting a game status, located in said housing;

a managing module located in said housing and configured for updating said game status according to respective at least one of said plurality of labeled game elements encoded in at least one of said plurality of unique visual machine-readable representations which are read by said reading unit; and a presentation unit configured for expressing at least one game instruction to the at least one player, said at least one game instruction being selected according to said adjusted game status;

wherein said reading unit based handheld plaything is a pawn indicating at least one of a character having at least one property in a multiplayer game and a progress of a player in a multi-stage game, said game related information being associated with an indication to at least one of a change in said property and a stage in said multi-stage game, said at least one game attribute defines at least one of a current level of said property and said progress.

18. The game management apparatus of claim 17, further comprising an additional reading unit configured for reading said plurality of game related information identifiers, said managing module being configured for adjusting said game status according to reading of said reading unit and said additional reading unit.

19. The handheld plaything of claim 1, wherein said reading unit reads a single unique visual machine-readable representation of game related information from a labeled game element.

20. The handheld plaything of claim 1, wherein said unique visual machine-readable representation is at least one of a barcode, a mark, a watermark, a symbol and a coded label.

21. The method of claim 12, wherein said reader based handheld plaything is used for reading a single unique visual machine-readable representation of game related information from a labeled game element.

22. The game management apparatus of claim 17, wherein said reading unit reads a single unique visual machine-readable representation of game related information from a labeled game element.

* * * * *